US007930975B2

(12) United States Patent
Cotet et al.

(10) Patent No.: US 7,930,975 B2
(45) Date of Patent: Apr. 26, 2011

(54) DECONFINEMENT DEVICE FOR THE CASING OF A PIECE OF AN AMMUNITION

(75) Inventors: Stéphane Cotet, Bourges (FR); Laurent Desgland, Les Aix d'Angillon (FR); Dominique Dion, Bourges (FR)

(73) Assignee: Nexter Munitions, Versailles (FR)

( * ) Notice: Subject to any disclaimer, the term of this patent is extended or adjusted under 35 U.S.C. 154(b) by 116 days.

(21) Appl. No.: 12/311,287

(22) PCT Filed: Sep. 19, 2007

(86) PCT No.: PCT/FR2007/001518

§ 371 (c)(1),
(2), (4) Date: Mar. 30, 2009

(87) PCT Pub. No.: WO2008/040860

PCT Pub. Date: Apr. 10, 2008

(65) Prior Publication Data

US 2010/0024675 A1 Feb. 4, 2010

(30) Foreign Application Priority Data

Sep. 29, 2006 (FR) ..... 06 08681

(51) Int. Cl.
*F42B 3/18* (2006.01)

(52) U.S. Cl. ..... 102/202.1; 102/481

(58) Field of Classification Search ..... 102/481, 102/202.1

See application file for complete search history.

(56) References Cited

U.S. PATENT DOCUMENTS

| | | | | |
|---|---|---|---|---|
| 2,007,732 | A | 7/1935 | Varaud | |
| 4,557,198 | A * | 12/1985 | Hickey | 102/481 |
| 5,035,181 | A | 7/1991 | Jacks et al. | |
| 7,025,000 | B1 | 4/2006 | Wong et al. | |
| 2006/0027126 | A1 * | 2/2006 | Aumasson et al. | 102/481 |

FOREIGN PATENT DOCUMENTS

| | | |
|---|---|---|
| DE | 2131748 | 12/1972 |
| DE | 43 36 808 A1 | 5/1995 |
| EP | 0 977 005 A1 | 2/2000 |
| FR | 2 686 410 | 7/1993 |
| FR | 2 742 221 | 6/1997 |
| FR | 2 864 219 | 6/2005 |
| GB | 964556 | 7/1964 |

* cited by examiner

*Primary Examiner* — Stephen M Johnson
(74) *Attorney, Agent, or Firm* — Oliff & Berridge, PLC

(57) ABSTRACT

A deconfinement device for the casing of a piece of ammunition enclosing an explosive load able to be ignited by a priming fuse, said device comprising a connecting ring linked to the casing and enabling the priming fuse to be joined to said casing, wherein said device incorporates a structure to ensure a weakened and shearable link between said fuse and said connecting ring, said link being sheared further to an increase in the pressure inside said casing, said connecting ring incorporating a base forming a plate that can be projected onto said explosive load during the ignition of said fuse, said base being able to be fractured by the presence of pressure inside said body of said projectile.

6 Claims, 5 Drawing Sheets

DECONFINEMENT DEVICE FOR THE CASING OF A PIECE OF AN AMMUNITION

BACKGROUND OF THE INVENTION

1. Field of the Invention

The technical scope of the invention is that of devices to ensure the deconfinement of an ammunition casing enclosing an explosive load and more particularly deconfinement devices for an explosive projectile body, whatever the caliber or type of weapon firing this projectile.

2. Description of the Related Art

Deconfinement devices enable the detonation of a projectile to be avoided further to overheating, for example during a fire.

When an explosive load is overheated, its breakdown generates gases which are trapped inside the projectile casing.

The pressure builds up strongly and causes the projectile to detonate.

It is known to provide deconfinement devices which enable such gases to be evacuated out of the projectile so as to avoid this build-up in pressure eventually leading to detonation.

Patent DE2131748 thus describes a closing plug for a projectile body which is put into position when the projectile is being stored. This plug incorporates a closing plate linked by a fusible material. The build up of temperature releases the plate thereby enabling the gases to evacuate.

However, such deconfinement means may only be implemented during a storage phase of the projectile, phase during which the fuse is dismounted.

Today, such protection is sought even for a projectile still carrying its priming fuse.

In this case, overheating can lead both to the ignition of the load itself further to a build-up in the pressure, and to the ignition of the fuse thereby also causing the explosive load to detonate.

A device is also known by patent FR2864219 that enables deconfinement when the fuse is mounted in the projectile body.

This device comprises a connecting ring that provides a link between the fuse and the projectile, such ring having radial vents inside which silicon plugs are arranged.

Although it is interesting, this device is, however, insufficiently effective since the total surface area of the vents is too small and does not enable a rapid deconfinement of the inside of the projectile body.

A device is also known by patent U.S. Pat. No. 5,035,181 to fasten a fuse to an ammunition body, such device incorporating a ring attached to the ammunition body by a layer of fusible material that melts further to an increase in the temperature. After fusion, the ring carrying the fuse is ejected by the action of a compression spring.

Such a device is complicated in that it implements a spring held in a compressed state. The mechanical strength of the fusible material is, furthermore, not ensured, namely after long period of storage, thereby endangering the reliability of this device.

Lastly, an impact marking projectile is known by patent DE4336808 that incorporates a fuse able to be ejected during the trajectory through the actions of a specific pyrotechnic charge. However, such a projectile does not incorporate an explosive load. With such a projectile, the problem of the protection of a load against increasing temperatures is not raised. Furthermore, the structure described is not adapted to the ignition of an explosive load.

SUMMARY OF THE INVENTION

The invention relates to a deconfinement device that simply and reliably ensures effective protection against accidental ignition due to the overheating of the explosive load of a piece of ammunition and in particular an artillery projectile.

The device according to the invention ensures this function in particular even when the fuse is mounted in the body of the projectile.

The device according to the invention, however, does not disturb the normal functioning of the ammunition, that is to say the ignition of the explosive load by the fuse.

Thus, the invention relates to a deconfinement device for the casing of a piece of ammunition enclosing an explosive load able to be ignited by a priming fuse, such device comprising a connecting ring linked to the casing and enabling the priming fuse to be joined to the casing, device wherein it incorporates means to ensure a weakened and shearable link between the fuse and the connecting ring, such link being sheared further to an increase in the pressure inside the casing, the connecting ring incorporating a base forming a plate that can be projected onto the explosive load during the ignition of the fuse, such base being able to be fractured by the presence of pressure inside the projectile.

The shearable linking means may comprise an intermediate ring that is positioned between the connecting ring and the fuse, ring which is linked to the fuse or to the connecting ring by a shearable element.

The intermediate ring may incorporate female threading to receive the fuse, the shearable element being arranged at an external surface of the intermediate ring.

The shearable element of the intermediate ring may incorporate at least one peripheral toothing intended to be accommodated in a matching channel made in the connecting ring.

The intermediate ring may incorporate at least two longitudinal grooves delimiting radially deformable lips, the deformation of such lips enabling the toothing to be put into position in their channels when the intermediate ring is being attached to the connecting ring.

The intermediate ring more particularly incorporates at least one longitudinal rib on its external surface, such rib intended to be housed in a matching groove in the connecting ring, and ensuring the immobilization in rotation of the intermediate ring with respect to the connecting ring.

The base may incorporate at least one circular channel ensuring a reduction in its thickness.

BRIEF DESCRIPTION OF DRAWINGS

The invention will become more apparent from the following description of a particular embodiment, such description being made with reference to the appended drawings, in which.

DETAILED DESCRIPTION OF PREFERRED EMBODIMENTS

Figure 1:
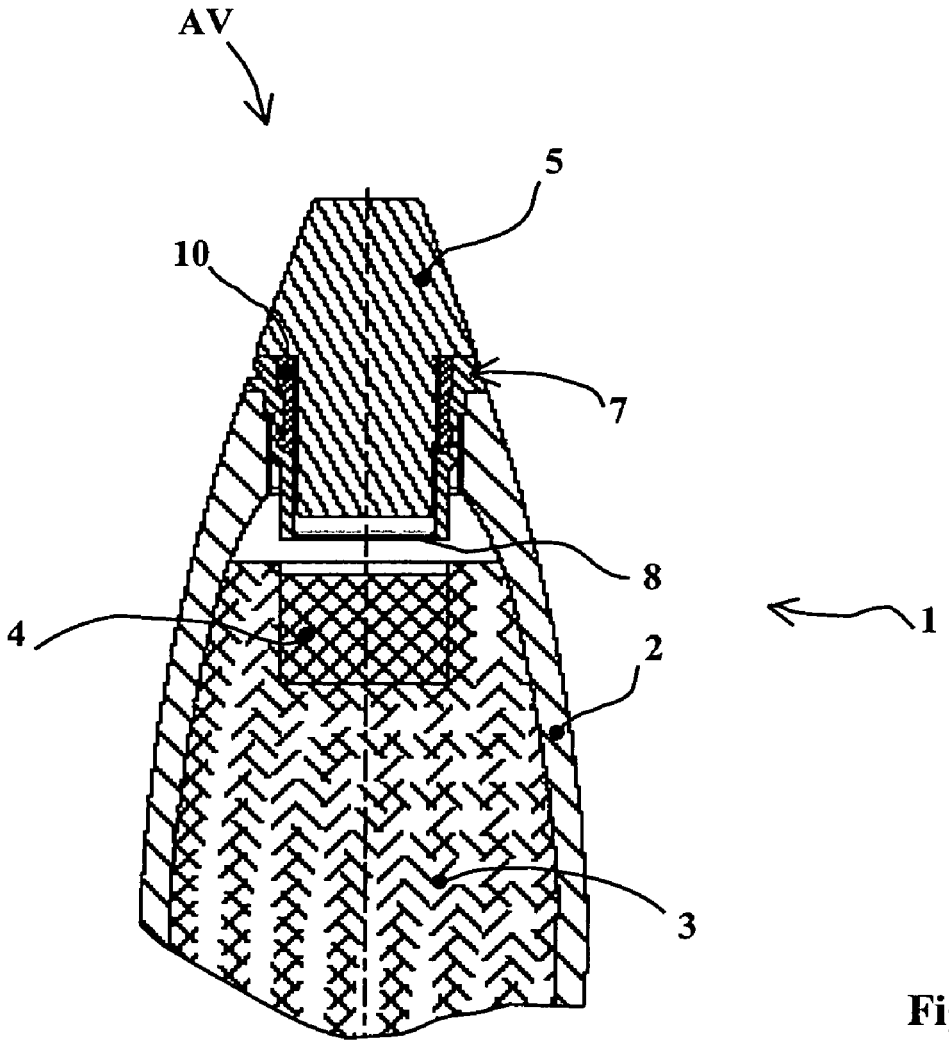
FIG. 1 is a partial schematic longitudinal section of a front part of a projectile fitted with a device according to one embodiment of the invention.
Figure 2A:
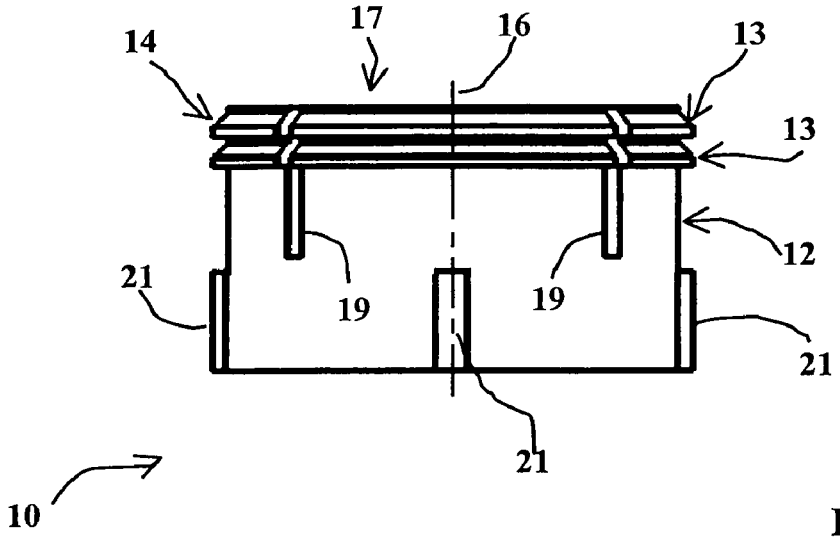
FIGS. 2*a*, 2*b*, 2*c* and 2*d* show an example embodiment of an intermediate ring of a device according to the invention, the ring being shown in a external view in FIGS. 2*a* and 2*b* and as a longitudinal section in FIG. 2*c*, such section being made along the plane referenced AA in FIG. 2*b*, FIG. 2*d* being a perspective view of the ring.
Figure 2B:
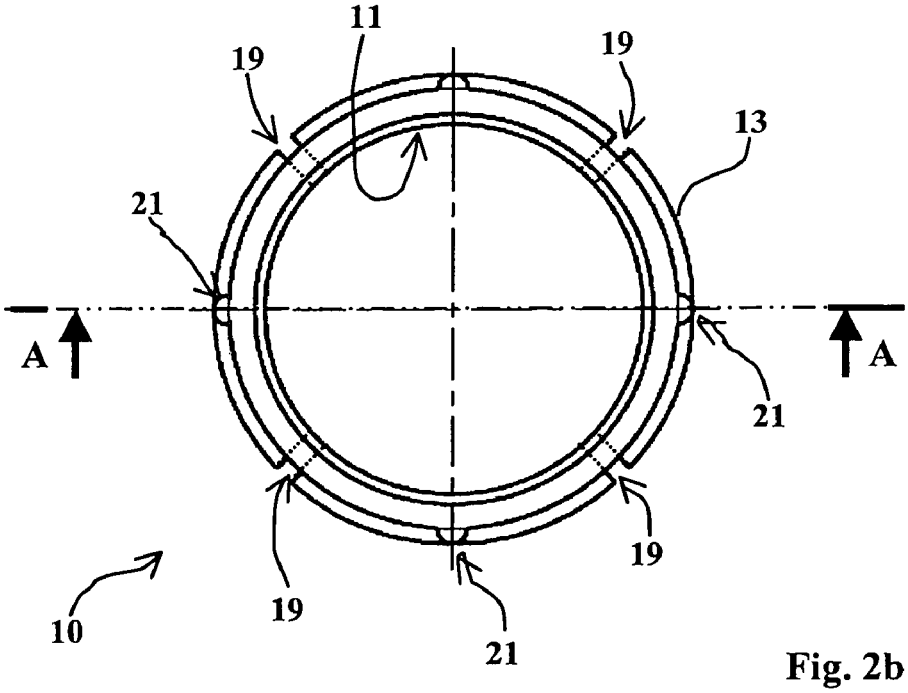
Figure 2C:
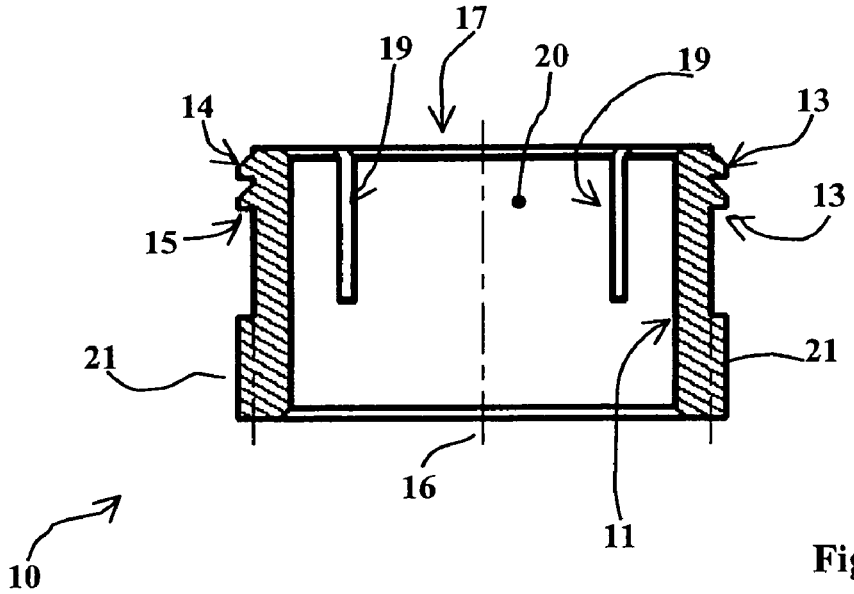
Figure 2D:
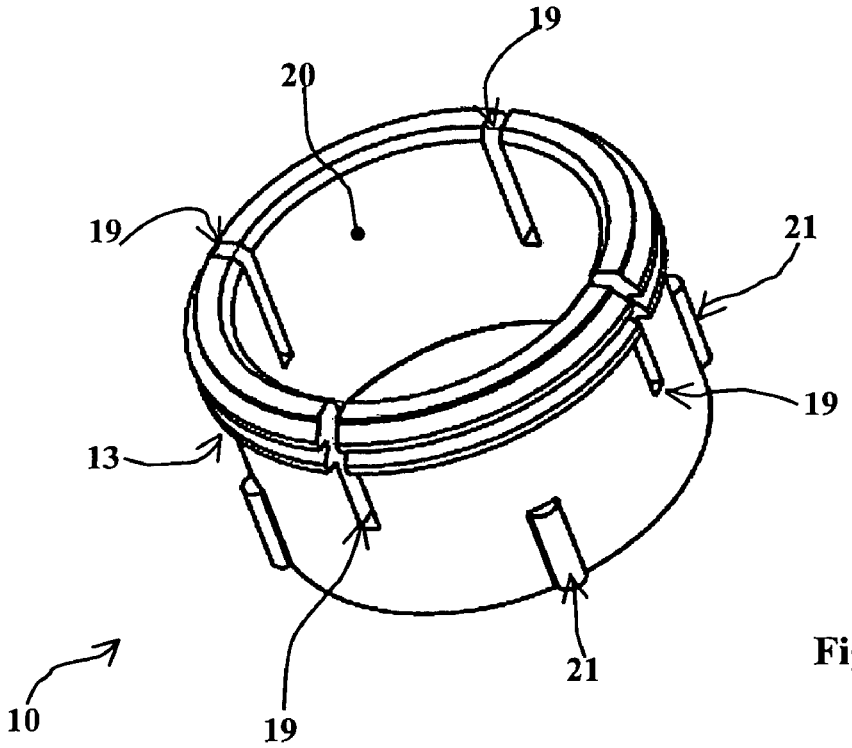

FIG. 1 shows a partial longitudinal section of the front part of a piece of ammunition 1 that is an artillery projectile. This projectile is shown schematically here. It incorporates a casing or body 2 enclosing an explosive load 3. Its front part AV carries a fuse 5.

The explosive load 3 has on its surface a pellet 4 of a priming explosive composition.

A connecting ring 7 is linked to the body 2 of the projectile by threading. This connecting ring incorporates a base 8 forming a plate that may be projected onto the explosive load 3, 4 when the fuse is ignited 5.

The base 8 will advantageously incorporate at least one circular channel 9 (see FIG. 3*b*) which ensures a reduction in its thickness. This channel is obtained by machining one face of the base. It thus forms a zone of reduced thickness for the base 8.

The ring 7 is made of steel. The thickness of the connecting ring at the base 8 is of around 1 mm.

Igniting the fuse 5 causes the base 8 to be cut out at the channel 9.

This results in the base 8 being projected onto the detonation relay 4 thereby ensuring the ignition of the explosive load 3.

Such a connecting ring incorporating a projectable base forms the subject of patent EP977005 and does not require further description here.

In accordance with the invention, the fuse 5 is fastened to the connecting ring 7 by means of linking means comprising an intermediate ring 10 positioned between the connecting ring 7 and the fuse 5. This intermediate ring 10 is linked to the fuse or to the connecting ring by a shearable element.

FIGS. 2*a* to 2*d* show the structure of the intermediate ring 10 in more detail.

This ring 10 is open at both ends. It incorporates an internal treading 11 enabling the fuse 5 to be screwed on. The intermediate ring 10 is made, for example, of a plastic material. Depending on the operational constraints, another material may be employed, for example brass.

The intermediate ring 10 incorporates two circular peripheral toothings 13 at its external cylindrical surface 12.

Each toothing 13 has a trapezoidal profile in section (see FIG. 2*c*) incorporating an inclined side 14 and a straight side 15 that is substantially perpendicular to axis 16 of the ring 10. The inclined side 14 is arranged at a front face 17 of the ring 10.

Figure 3A:
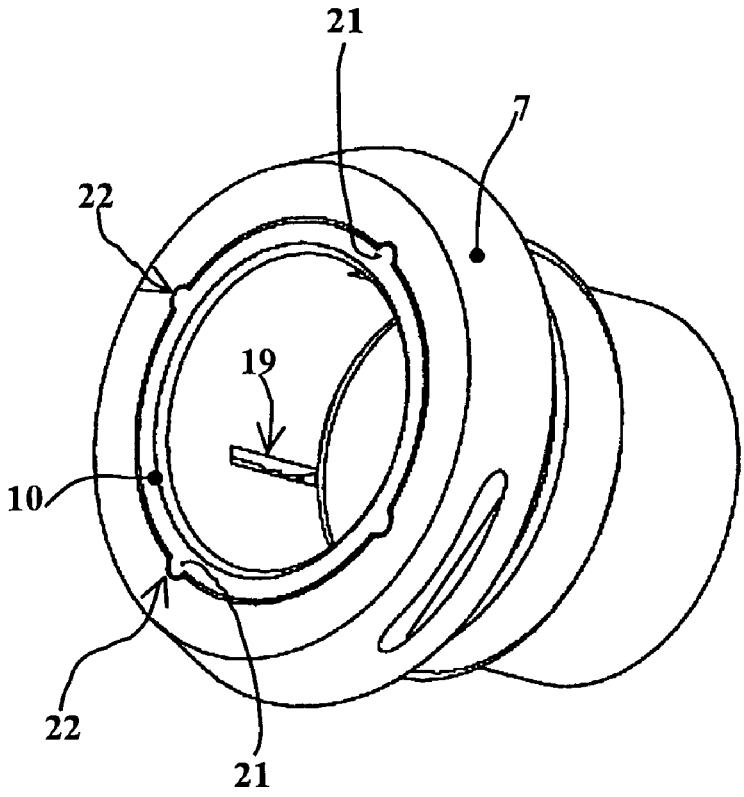
FIGS. 3*a* and 3*b* show the intermediate ring assembled with the connecting ring, FIG. 3*a* being a perspective view of this assembly and FIG. 3*b* a longitudinal section view, FIG. 4 lastly schematizes the functioning of the device according to the invention.
Figure 3B:
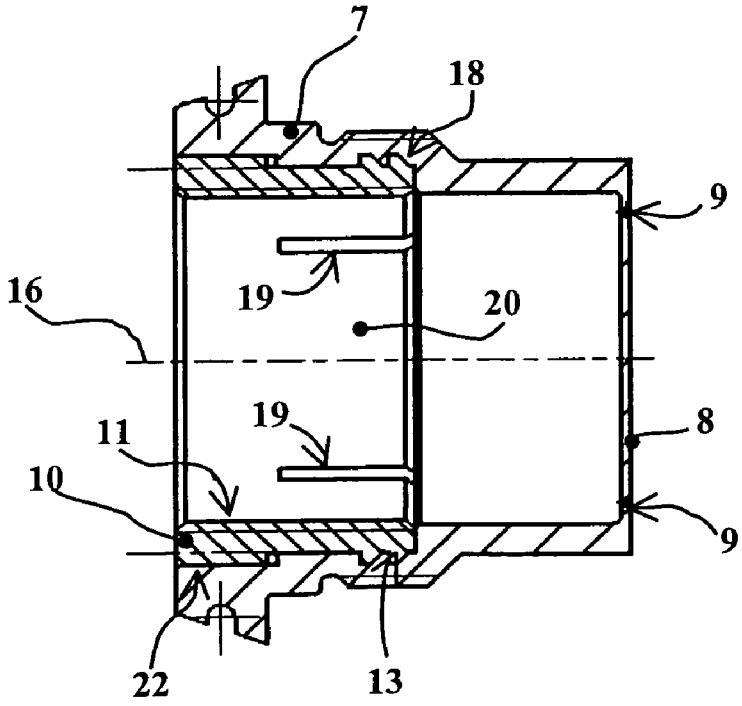

These toothings 13 are intended to be housed in matching channels 18 in the connecting ring 7 (see FIG. 3*b*).

The intermediate ring 10 furthermore incorporates at least two longitudinal slots 19 which extend substantially over half the total height of the ring 10 and which delimit radially deformable lips 20.

There are four slots 19 on the ring 10, evenly spaced angularly and therefore delimiting four lips 20 able to deform radially.

The deformation of the lips 20 enables the intermediate ring 10 to be put into position in the connecting ring 7.

As they are being put into position and because of the orientation of the inclined sides 14 of the toothings 13 to the front of the intermediate ring 10, the lips 20 slide and deform radially without difficulty. Their elasticity enables them to take up their initial position when the toothing 13 is inserted in their channels 18.

The straight sides 15 of the toothing 13 prevent any backward movement of the intermediate ring 10 which is thus now integral with the connecting ring 7.

Furthermore, the intermediate ring 10 incorporates longitudinal ribs 21 carried on its external surface 12.

These ribs are intended to be housed in matching grooves 22 in the connecting ring 7 (see FIGS. 3*a* and 3*b*).

The ribs 21 enable the immobilization in rotation of the intermediate ring 10 with respect to the connecting ring 7.

The intermediate ring 10 after being mounted is thus totally integral both in rotation and in translation with the connecting ring 7.

Any risk of relative vibration of one ring with respect to the other, and the subsequent unscrewing of the fuse 5, is thereby avoided.

In place of the ribs 21, cotters may be used that are housed in grooves in the intermediate ring and the connecting ring.

FIGS. 3*a* and 3*b* show the intermediate ring 10 fastened to the connecting ring 7.

The lips 13 constitute a shearable element ensuring a fastening between the two rings 7 and 10.

Once the fuse 5 has been screwed onto the intermediate ring 10, the lips 20 are no longer able to deform radially. Furthermore, the straight sides 15 of the toothings 13 prevent the intermediate ring 10 from being extracted.

The number and dimensions of the toothing 13 will be selected according to the minimal pressure at which the deconfinement of the projectile is to be made.

In effect, the presence of a pressure inside the body 2 of the projectile 1 will firstly cause the partition 8 to fracture. The pressure is thus exerted thereafter on the fuse 5 driving the intermediate ring 10. This results in a shearing stress which is exerted on the toothings 13.

When the required shearing force is reached the toothings 13 fracture and the fuse 5 is ejected.

Figure 4:
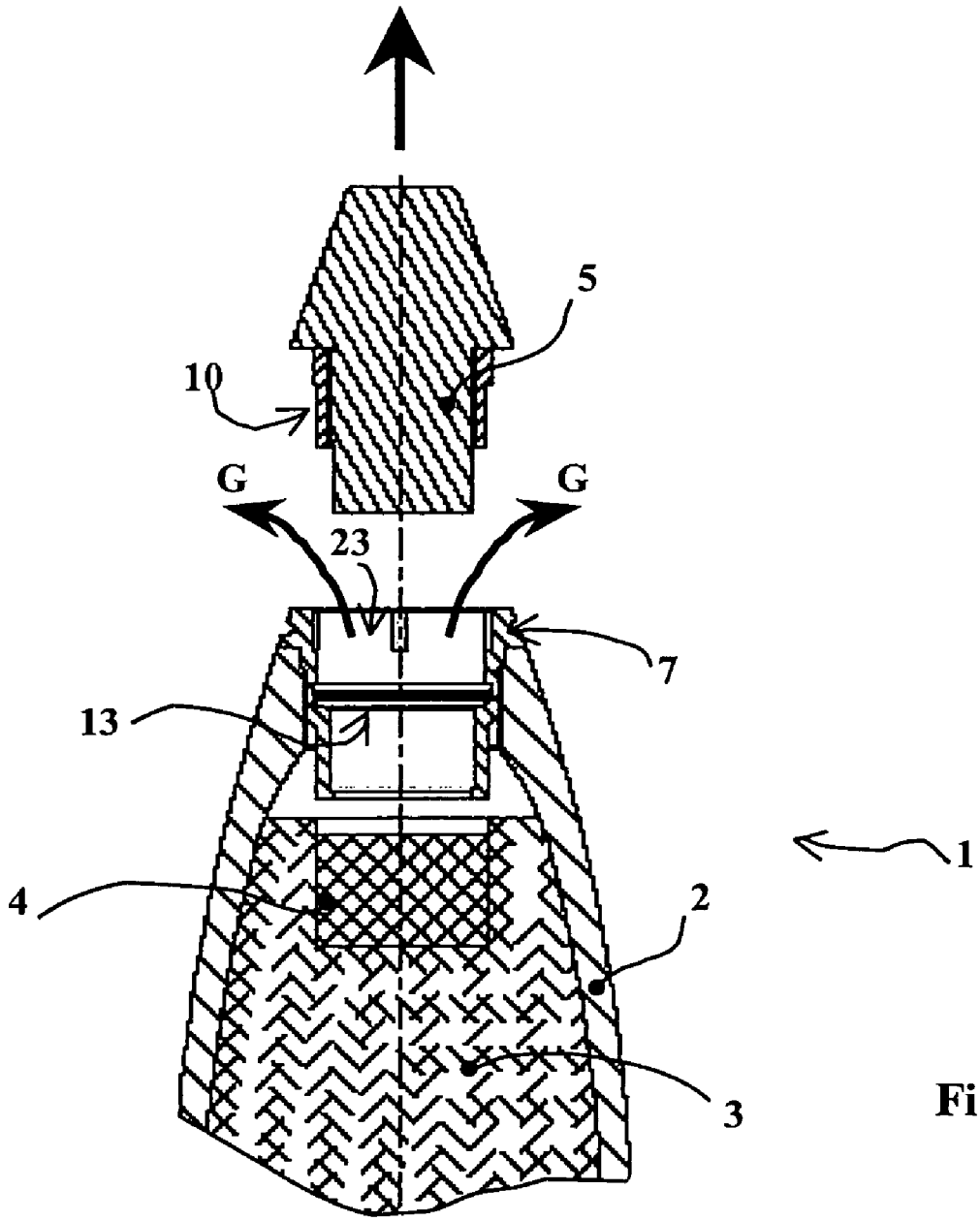

FIG. 4 thus shows the projectile 1 after fracturing of the toothings 13. The fuse 5 drives with it part of the intermediate ring 10. The toothings 13 remain in its channels 18.

The ejection of the fuse 5 leads to the opening of the filling aperture 23 of the projectile. Deconfinement is ensured with maximal opening for the evacuation of the gases G.

The deconfinement device according to the invention thus simply and reliably ensures the protection of a projectile having a priming fuse.

Note that if the projectile is stored without its fuse, deconfinement is nevertheless ensured thanks to the presence of the channel 9.

The build-up of pressure in the projectile casing will cause (as in the previous case of a primed projectile) the opening of the base 8 at the channel 9. The projectile is thus immediately deconfined.

It is naturally possible, by way of a variant, to provide a different number of channels at the base 8.

It is also possible for shearable linking means to be defined of a different structure.

For example, an intermediate ring 10 may be defined that, in place of the circular toothing 13, incorporates shearable threading cooperating with internal threading made inside the connecting ring 7.

To moderate the resistance of this shearable threading, threading may be made which does not cover the whole of the external cylindrical surface of the intermediate ring 10 but which is interrupted by non-threaded longitudinal areas evenly spaced angularly.

By way of a variant, it is also possible for a device to be defined in which there is no intermediate ring 10. In this device, the shearable linking means will be constituted by a specific threading made inside the connecting ring 7. This threading will be defined such that it shears when the presence of internal pressure exceeds a certain threshold.

Threading may be made, for example, which does not cover the whole of the internal cylindrical surface of the connecting ring 7 but which is interrupted by non-threaded longitudinal areas evenly spaced angularly.

The invention claimed is:

1. A deconfinement device for the casing of a piece of ammunition enclosing an explosive load able to be ignited by a priming fuse, the deconfinement device comprising:

a connecting ring linked to the casing and enabling the priming fuse to be joined to the casing, a shearable link between the fuse and the connecting ring, wherein the shearable link shears by a predetermined increase in a pressure inside the casing, wherein the connecting ring comprises a base comprising a plate portion that projects onto the explosive load during an ignition of the priming fuse, the base being configured to be fractured by a pressure inside of the body of the projectile, wherein the shearable link comprises an intermediate ring that is positioned between the connecting ring and the fuse, and the intermediate ring is linked to the connecting ring by a shearable element, and wherein the intermediate ring comprises a female threaded portion that receives the fuse, and the shearable element is arranged at an external surface of the intermediate ring.

2. The deconfinement device according to claim 1, wherein the shearable element of the intermediate ring comprises at least one peripheral toothing, and the connecting ring comprises a matching channel that accommodates the at least one peripheral toothing.

3. The deconfinement device according to claim 2, wherein the intermediate ring comprises at least two longitudinal grooves delimiting radially deformable lips, and wherein a deformation of the radially deformable lips enables the at least one peripheral toothing to be positioned in the matching channels of the connecting ring such that the intermediate ring is attached to the connecting ring.

4. The deconfinement device according to claim 3, wherein the intermediate ring comprises at least one longitudinal rib on an external surface of the intermediate ring, the at least one longitudinal rib being configured to be housed in a matching groove in the connecting ring, wherein the rib being housed in the matching groove prevents a rotation of the intermediate ring with respect to the connecting ring.

5. The deconfinement device according to claim 2, wherein the intermediate ring comprises at least one longitudinal rib on an external surface of the intermediate ring, the at least one longitudinal rib being configured to be housed in a matching groove in the connecting ring, wherein the rib being housed in the matching groove prevents a rotation of the intermediate ring with respect to the connecting ring.

6. The deconfinement device according to claim 1, wherein the base comprises at least one circular channel having a reduced thickness.

* * * * *